US007179104B2

(12) United States Patent
Wada et al.

(10) Patent No.: US 7,179,104 B2
(45) Date of Patent: Feb. 20, 2007

(54) CONNECTOR WHICH CAN BE REDUCED IN SIZE

(75) Inventors: Takamitsu Wada, Tokyo (JP); Keisuke Nakamura, Tokyo (JP); Akira Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/394,046

(22) Filed: Mar. 30, 2006

(65) Prior Publication Data

US 2006/0223352 A1 Oct. 5, 2006

(30) Foreign Application Priority Data

Mar. 31, 2005 (JP) ..... 2005-101847

(51) Int. Cl.
*H01R 13/62* (2006.01)

(52) U.S. Cl. ..... 439/159; 439/630

(58) Field of Classification Search ..... 439/159, 439/152, 155, 160, 630
See application file for complete search history.

(56) References Cited

U.S. PATENT DOCUMENTS 6,796,816 B2 * 9/2004 He ..... 439/159
6,878,003 B2 * 4/2005 Natori ..... 439/159
6,986,675 B2 * 1/2006 Takada ..... 439/159
2002/0048979 A1 * 4/2002 Kodama et al. ..... 439/159
2003/0124890 A1 * 7/2003 Harasawa et al. ..... 439/159
2004/0067668 A1 * 4/2004 Hirata et al. ..... 439/159

FOREIGN PATENT DOCUMENTS

JP 2001267013 9/2001

* cited by examiner

*Primary Examiner*—Hien Vu
(74) *Attorney, Agent, or Firm*—Collard & Roe, P.C.

(57) ABSTRACT

In a card connector to be connected to a card, An ejecting member is provided so as to be movable along a predetermined plane for ejecting the card in an ejecting direction. The ejecting member has a card contacting portion to be contacted with the card and a cam-operated portion. The ejecting member is urged towards the ejecting direction by a urging member. A cam mechanism is provided so as to movable along the predetermined plane in a direction intersecting the ejecting direction. The cam mechanism is elastically supported by a supporting member so that it is disposed at a predetermined position. The cam mechanism has a cam portion for controlling a position of the ejecting member in cooperation with the cam-operated portion.

9 Claims, 13 Drawing Sheets

CONNECTOR WHICH CAN BE REDUCED IN SIZE

This application claims priority to prior Japanese patent application JP 2005-101847, the disclosure of which is incorporated herein by reference.

BACKGROUND OF THE INVENTION

This invention relates to a card connector for use in connecting a card.

At present, various types of cards generally called an IC card or a memory card are used in an electronic apparatus. Typically, the card is removably inserted into a card connector mounted or connected to the electronic apparatus.

For example, a card connector of the type is disclosed in Japanese Unexamined Patent Application Publication (JP-A) No. 2001-267013. The card connector is adapted to be mounted to an electronic apparatus and comprises an insulator of a generally rectangular shape, a plurality of contacts held by the insulator, an eject lever coupled to the insulator to be slidable in inserting and removing directions for ejecting a card, and a spring for continuously urging the eject lever in an ejecting direction, namely, the removing direction. The eject lever is provided with a heart cam. On the other hand, the insulator is provided with a cam follower to be engaged with the heart cam. The heart cam has a cam groove.

The cam groove has a bottom provided with a plurality of steps in order to prevent reverse or backward running of the cam follower and a slope in front of each step in order to allow normal or forward running of the cam follower. As a consequence, the heart cam is inevitably increased in thickness in correspondence to the steps.

In addition, a spring for pressing the cam follower to the heart cam is required. Therefore, it is difficult to reduce the total thickness of a cam mechanism comprising the heart cam, the cam follower, and the spring.

When the card is inserted, a rotation torque is applied to the eject lever. With this structure, friction is produced between the lever and other elements during operation to impair an operation feeling.

SUMMARY OF THE INVENTION

It is therefore an object of this invention to provide a card connector which can be reduced in thickness of a cam mechanism.

It is another object of this invention to provide a card connector which can be reduced in friction between elements to enhance an operation feeling.

It is still another object of this invention to provide a card connector which can be reduced in spring force to assure a sufficient margin in strength of a housing and to reduce deformation of each element so that friction with another element is suppressed and an operation feeling is not impaired.

It is yet another object of this invention to provide a card connector in which a collision sound upon operation can easily be increased so as to enhance an operation feeling.

Other objects of the present invention will become clear as the description proceeds.

According to an aspect of the present invention, there is provided a card connector to be connected to a card, the card connector comprising an ejecting member movable along a predetermined plane for ejecting the card in an ejecting direction, the ejecting member having a card contacting portion to be contacted with the card and a cam-operated portion, an urging member urging the ejecting member towards the ejecting direction, a cam mechanism movable along the predetermined plane in a direction intersecting the ejecting direction, and a supporting member elastically supporting the cam mechanism so that the cam mechanism is disposed at a predetermined position, the cam mechanism having a cam portion for controlling a position of the ejecting member in cooperation with the cam-operated portion.

According to another aspect of the present invention, there is provided a card connector to be connected to a card, the card connector comprising an ejecting member to be contacted with the card for ejecting the card, an elastic member urging the ejecting member towards a card ejecting direction, and a cam mechanism having a cam portion to be engaged with a cam-operated portion of the ejecting member, the cam portion being operable to lock the ejecting member at a card fitting position when the card is inserted and to unlock the ejecting member when the card is ejected, the cam mechanism further comprising a rotation shaft and a supporting member, the cam mechanism being rotatably held by the rotation shaft, the supporting member urging the cam mechanism so that the cam mechanism is disposed at a predetermined position.

DESCRIPTION OF THE PREFERRED EMBODIMENT

Figure 1:
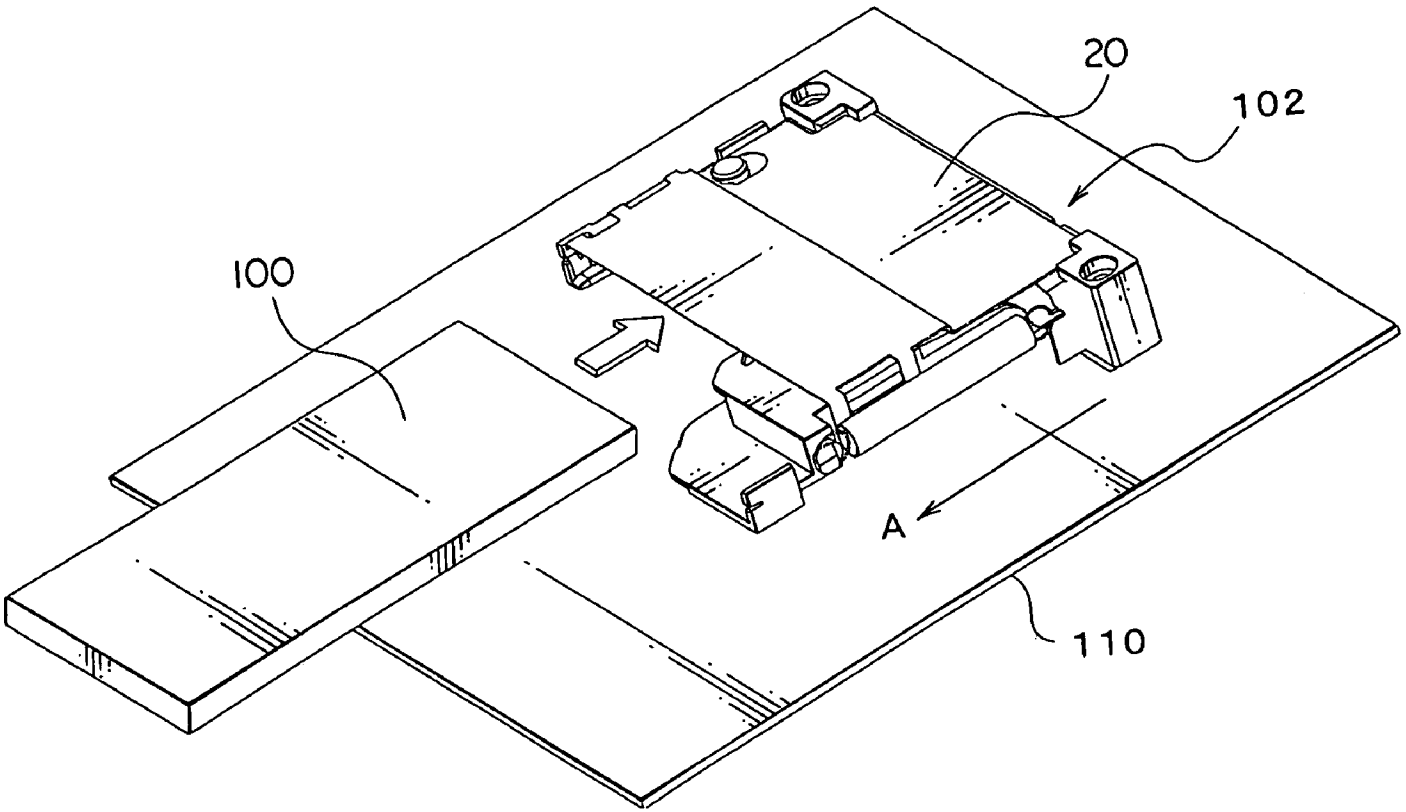
FIG. 1 is a perspective view showing a card connector according to an embodiment of this invention together with a substrate and a card.
Figure 2:
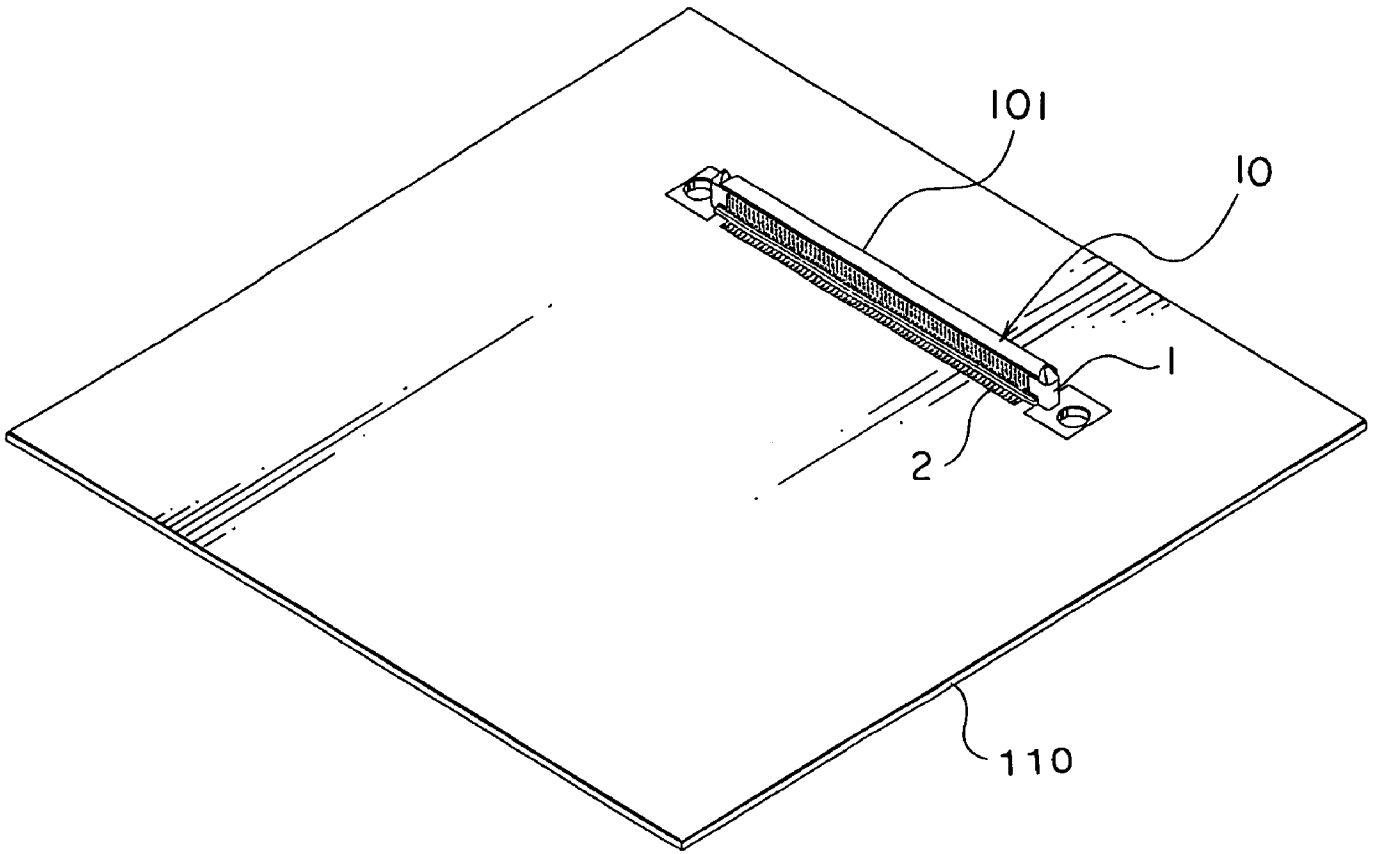
FIG. 2 is a perspective view of the card connector in FIG. 1 in a state where the card and a frame portion of the card connector are omitted.

Referring to FIGS. 1 to 5, description will be made of a structure of a card connector according to an embodiment of this invention.

The card connector illustrated in the figures is depicted by a reference numeral 102. The card connector 102 is mounted on a substrate 110 built in an electronic apparatus and is used for connecting a memory card 100. The card connector 102 comprises a base portion 101 automatically mounted at a predetermined position on the substrate 110, and a frame portion 20 coupled to the base portion 101 and fixed to the substrate 110. The base portion 101 comprises a number of base contacts 2 made of metal and soldered to the substrate 110, and a base housing 1 made of resin and fixedly holding the base contacts 2 by press-fitting.

Figure 4:
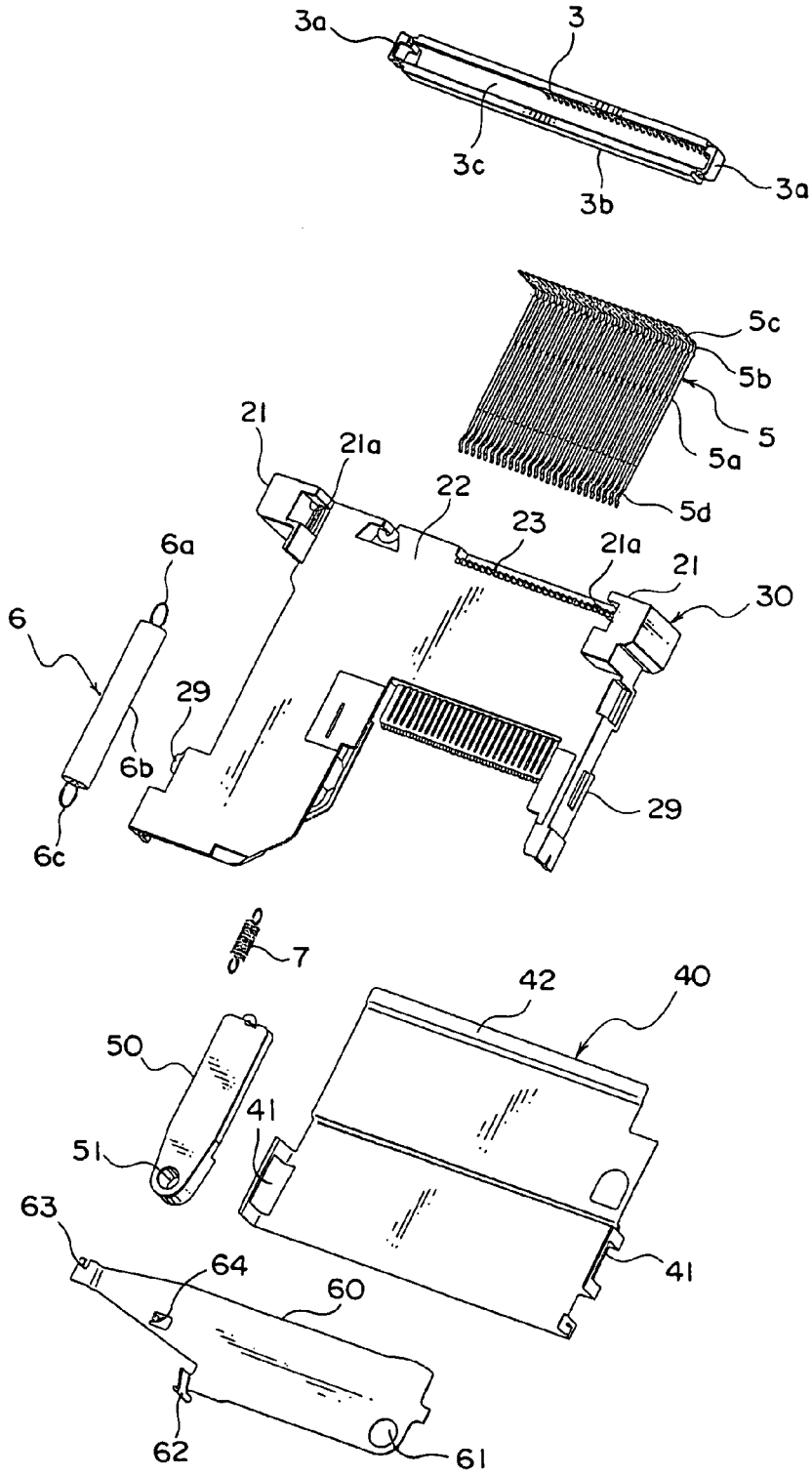
FIG. 4 is an exploded perspective view of the card connector in FIG. 1 as seen from a bottom side.

The frame portion 20 covers the base portion 101 mounted to the substrate 110 and comprises a locator 3 made of resin, a plurality of contacts 5 made of metal, a housing 30 made of resin, a cover 40 made of metal, a heart cam 50 made of resin and serving as a cam portion, a lever 60 made of metal and serving as an ejecting member for ejecting the card 100, a first spring 6 of an elastic member, and a second spring 7 as a supporting member. The housing 30 has a protrusion which serves as a rotation shaft 24. A combination of the heart cam 50, the rotation shaft 24 fitted to a rotation hole 51 of the heart cam 50, and the second spring 7 forms a cam mechanism. As illustrated in FIG. 4, the locator 3 has left and right protrusions 3*a* press-fitted to a U-shaped portion 21*a* of the housing 30 to be fixed.

The contacts 5 has press-fit portions 5*a* and 5*b* press-fitted to holes (not shown) of the housing 30 so that the contacts 5 are fixed to the housing 30. The rotation hole 51 of the heart cam 50 is fitted over the rotation shaft 24 of the housing 30 so that the heart cam 50 is rotatable.

The second spring 7 is a coil spring having a coil body 7*c*. The coil body 7*c* has one end provided with a hook 7*a* engaged with a protrusion 26 of the housing 30 and the other end provided with a hook 7*b* engaged with a protrusion 52 of the heart cam 50. In this state, the heart cam 50 is continuously applied with a pulling force from the second spring 7 to be kept at an uninclined or untilted position (i.e., a position substantially parallel to an ejecting direction or a removing direction depicted by an arrow A).

The lever 60 has a hole 61 fitted over a rotation shaft 27 of a cylindrical protrusion of the housing 30 to be rotatable in a predetermined plane. The lever 60 has a card contacting or ejecting portion 62 to be engaged or contacted with the memory card 100 when the memory card 100 is ejected and inserted.

The first spring 6 comprises a tension coil spring and has hooks 6*a* and 6*b* formed at opposite ends thereof. The hook 6*a* is engaged with a spring attaching portion 63 comprising a protrusion at a rotating end of the lever 60. The hook 6*b* is engaged with a cylindrical protrusion 28 of the housing 30. The lever 60 is continuously applied with a pulling force from the first spring 6 to be urged in the ejecting direction A around the rotation shaft 27. Thus, the first spring 6 serves as an urging member for urging the lever 60 in the ejecting direction A.

The heart cam 50 comprises a depressed portion 50*a* having a bottom surface parallel to the predetermined plane and having no step, and a protruding portion 50*b* disposed on the depressed portion 50*a* and defining a generally heart-like contour. The protruding portion 50*b* has a recess 58 formed at an end portion near to the protrusion 52.

The cover 40 has left and right holes 41 and a guiding portion 42. The left and right holes 41 are fitted over protrusions 29 of the housing 30 and the guide portion 42 is fitted to a slit portion 31 so that the cover 40 is fixed.

The lever 60 has a card ejecting portion 62 formed on a side near the rotation hole 51 formed near a forward end of a recess 25 of the housing 30. The positional relationship at that portion may be represented by a leverage or lever ratio given by:

$$g \times e = h \times f \quad (1),$$

where g represents a card removing force, e, a distance between the rotation shaft 27 and a card ejecting position 62, h, a force exerted by the first spring 6 to urge the lever 60 in the ejecting direction A, and f, a distance between the rotation shaft 27 and the spring attaching portion 63. Actually, in order to eject the card 100, the relationship must be:

$$g \times e < h \times f.$$

Thus, the rotation torque for ejecting the card 100 is increased.

Figure 3:
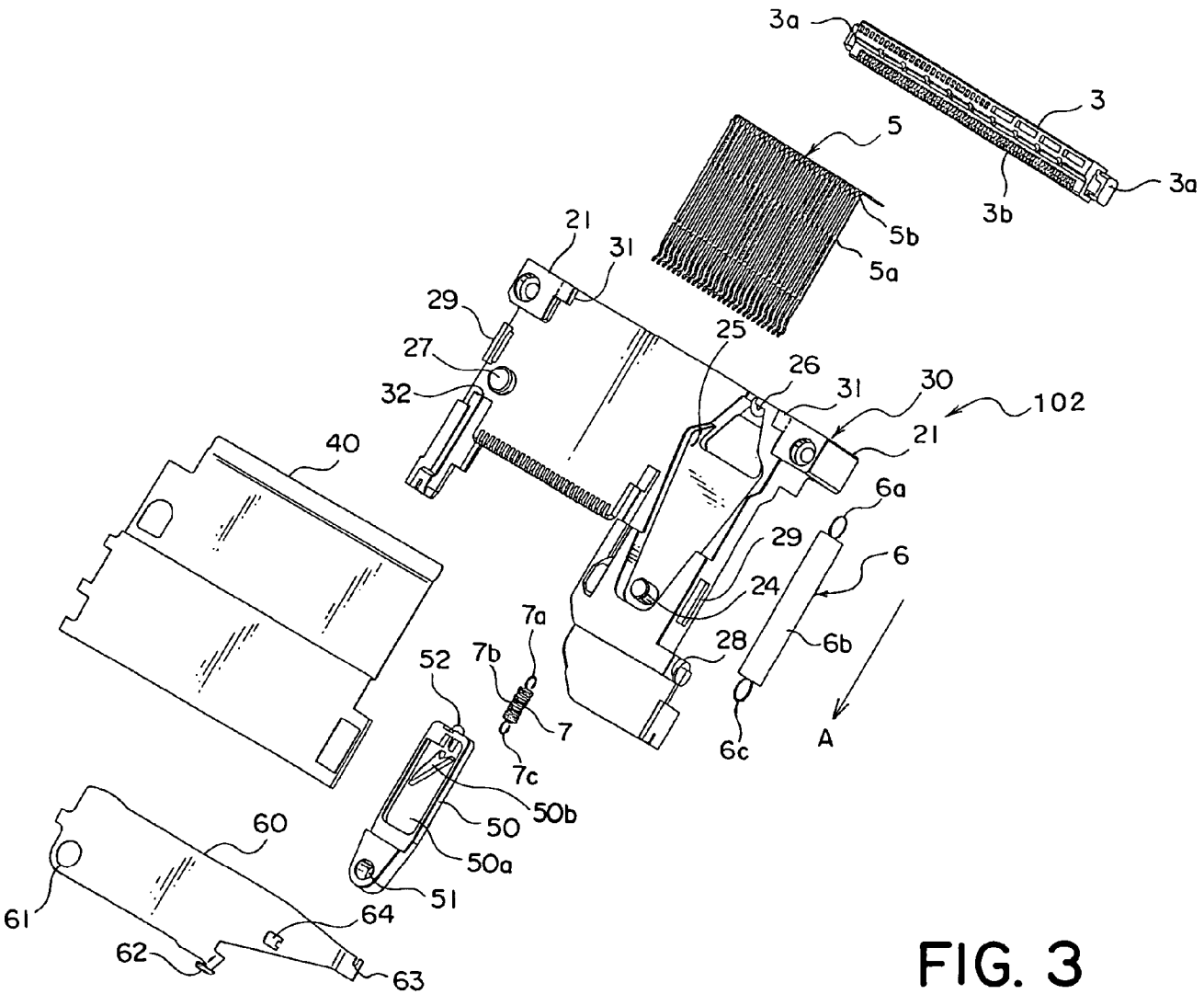
FIG. 3 is an exploded perspective view of the card connector in FIG. 1 as seen from a top side.

Referring to FIGS. 6 to 13B, description will be made of an operation of the card connector illustrated in FIG. 3.

Figure 6:
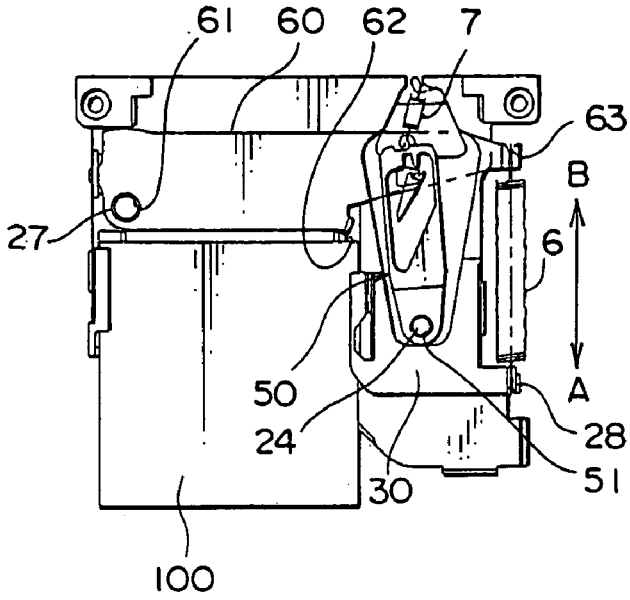
FIG. 6 is a top plan view for describing an operation of the card connector in FIGS. 1 to 5 when the card is inserted.
Figure 6A:
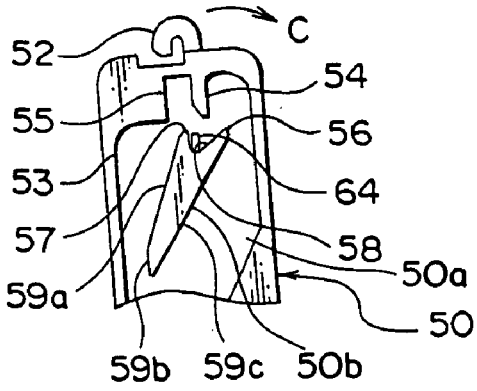
FIG. 6A is an enlarged view of a characteristic part in FIG. 6.

In FIGS. 6 and 6A, the memory card 100 is inserted. In this state, the lever 60 is applied with a force by the first spring 6 in the ejecting direction A around the rotation shaft 27 of the housing 30. However, since a protrusion 64 of the lever 60 as a cam follower is fitted to the recess 58 of the heart cam 50, the card ejecting portion 62 of the lever 60 can not rotate any further in the ejecting direction A. Therefore, the memory card 100 can be held at its initial position. At this time, the heart cam 50 is applied with a rotation force by the second spring 7 in a clockwise direction C.

Figure 7:
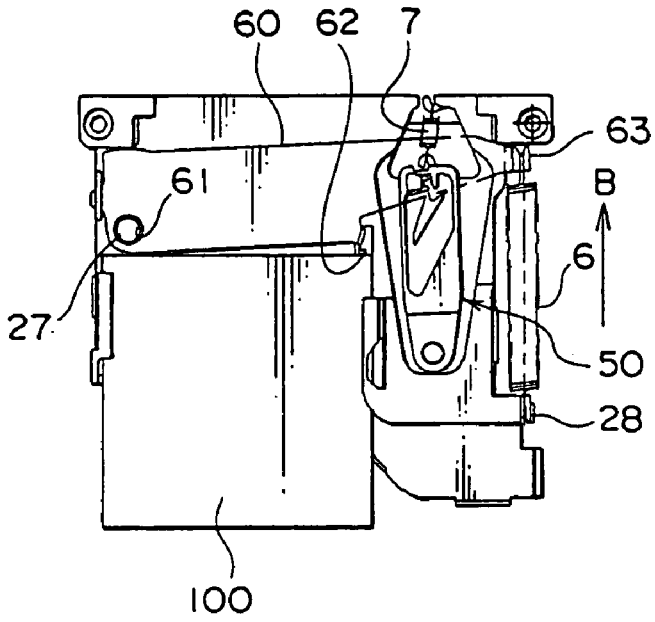
FIG. 7 is a top plan view for describing an operation of the card connector in FIGS. 1 to 5 in a first stage when the card is ejected.
Figure 7A:
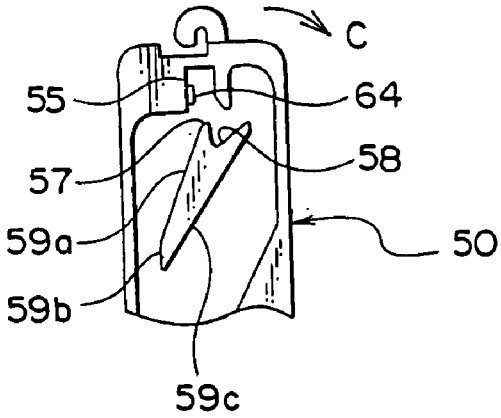
FIG. 7A is an enlarged view of a characteristic part in FIG. 7.

Referring to FIGS. 7 and 7A, the memory card 100 is going to be ejected. From the state illustrated in FIGS. 6 and 6A, the memory card 100 is pushed in a inserting direction B to an innermost position. When the memory card 100 is pushed inward in the inserting direction B, the card ejecting portion 62 of the lever 60 is pushed so that the lever 60 is rotated in the inserting direction B around the rotation shaft 27 of the insulator 30. Then, the protrusion 64 of the lever 60 is disengaged from the recess 58 of the heart cam 50 and moves over a protrusion 57. However, since the heart cam 50 is pulled by the second spring 7, the heart cam 50 is rotated in the clockwise direction C to take the untilted position. The protrusion 64 of the lever 60 collides with a wall 55 of the heart cam 50. At this time, a collision sound is generated and rotation of the heart cam 50 is stopped.

Figure 8:
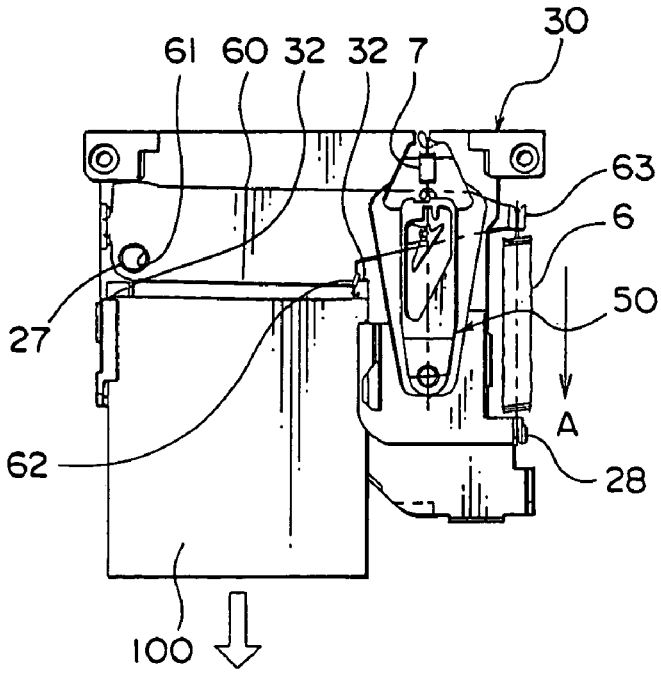
FIG. 8 is a top plan view for describing an operation of the card connector in FIGS. 1 to 5 in an intermediate stage when the card is ejected.
Figure 8A:
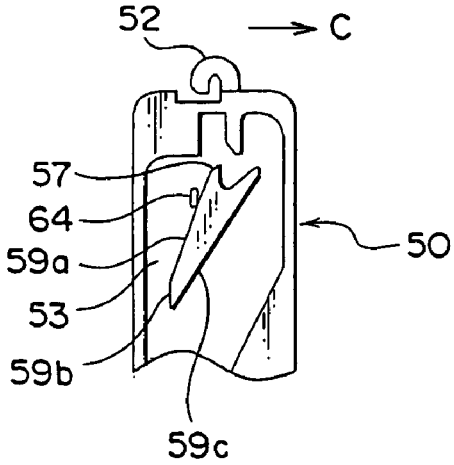
FIG. 8A is an enlarged view of a characteristic part in FIG. 8.

Referring to FIGS. 8 and 8A, the memory card 100 is ejected. Specifically, from the state illustrated in FIGS. 7 and 7A, the memory card 100 collides with a wall 32 of the housing 30 and the pushing force of the memory card 100 is weakened. At this time, the lever 60 is applied with a force by the first spring 6 in the ejecting direction A and rotated around the rotation shaft 27 of the housing 30 to eject the memory card 100 via the card ejecting portion 62. The heart cam 50 is pulled by the second spring 7 to rotate in the clockwise direction C so that the heart cam 50 takes the untilted position. The protrusion 64 of the lever 60 passes over a left side of the protrusion 57 of the heart cam 50. When the lever 60 is moved in the ejecting direction A, the heart cam 50 is pushed by the protrusion 64 of the lever 60 and is rotated in the clockwise direction C.

Figure 9:
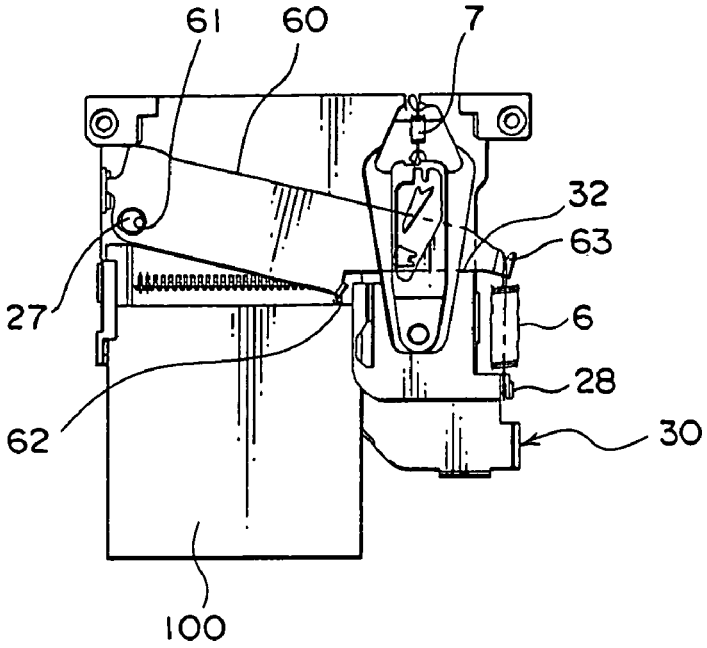
FIG. 9 is a top plan view for describing an operation of the card connector in FIGS. 1 to 5 in a last stage when the card is ejected.
Figure 9A:
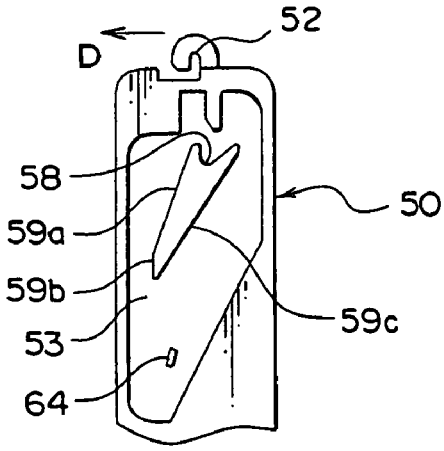
FIG. 9A is an enlarged view of a characteristic part in FIG. 9.

Referring to FIGS. 9 and 9A, the memory card 100 is completely ejected. The lever 60 applied with the force by the first spring 6 in the ejecting direction A collides with the wall 32 of the housing 30 and the rotation of the lever 60 is stopped. The memory card 100 is also stopped. At this time, the heart cam 50 is rotated in a counterclockwise direction D under the force from the second spring 7 and takes the untilted position.

Figure 10:
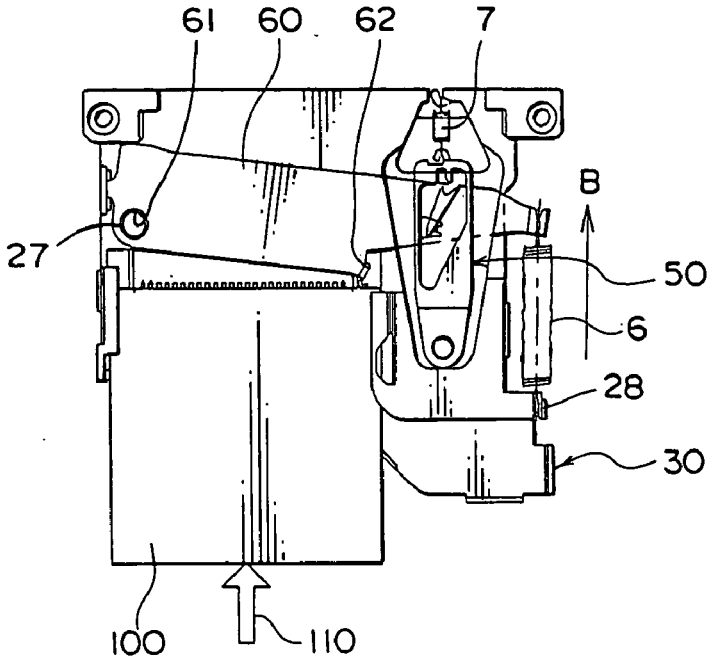
FIG. 10 is a top plan view for describing an operation of the card connector in FIGS. 1 to 5 in a first stage when the card is inserted.
Figure 10A:
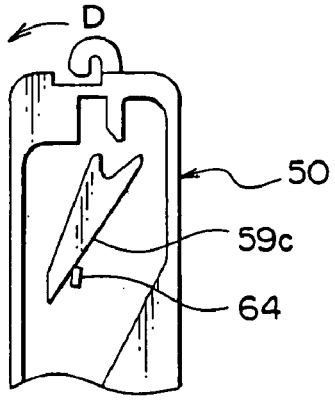
FIG. 10A is an enlarged view of a characteristic part in FIG. 10.

Referring to FIGS. 10 and 10A, the memory card 100 is inserted. When the memory card 100 is inserted, the lever 60 is rotated via the card ejecting portion 62 around the rotation shaft 27 of the housing 30 in the inserting direction B. At this time, the protrusion 64 of the lever 60 collides with a wall 59 of the heart cam 50 so that the heart cam 50 is rotated around the rotation shaft 24 of the housing 30.

Figure 11:
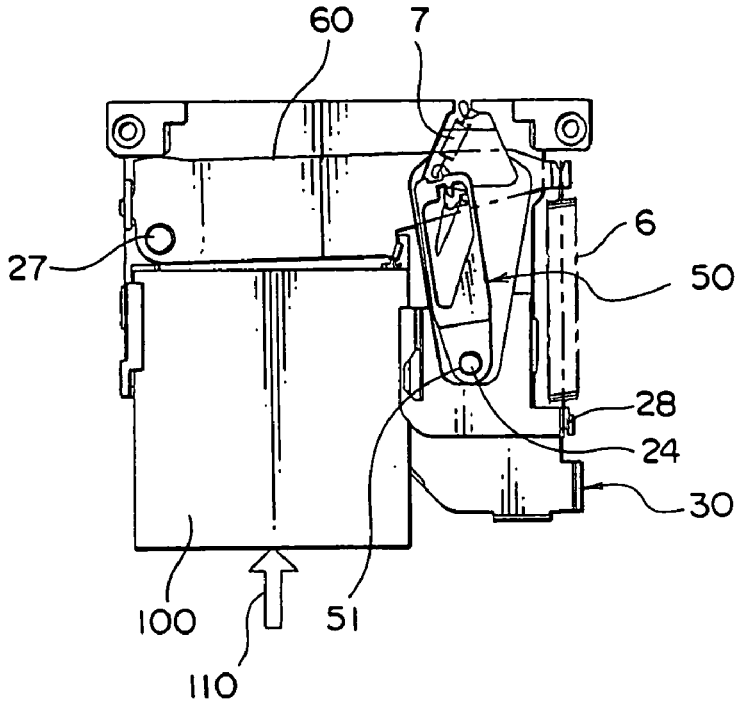
FIG. 11 is a top plan view for describing an operation of the card connector in FIGS. 1 to 5 in an intermediate stage when the card is inserted.
Figure 11A:
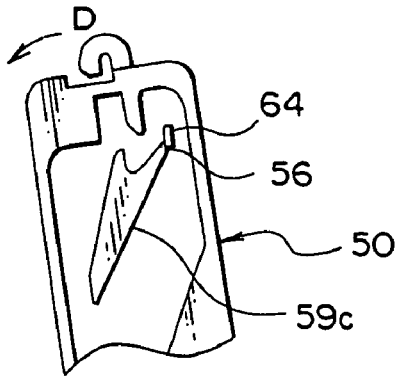
FIG. 11A is an enlarged view of a characteristic part in FIG. 11.

Referring to FIGS. 11 and 11A, the memory card 100 is inserted in the manner similar to FIGS. 10 and 10A. In this state also, the protrusion 64 collides with the wall 59 of the heart cam 50. The heart cam 50 is rotated around the rotation shaft 24 to have a maximum displacement in the counterclockwise direction D.

Figure 12:
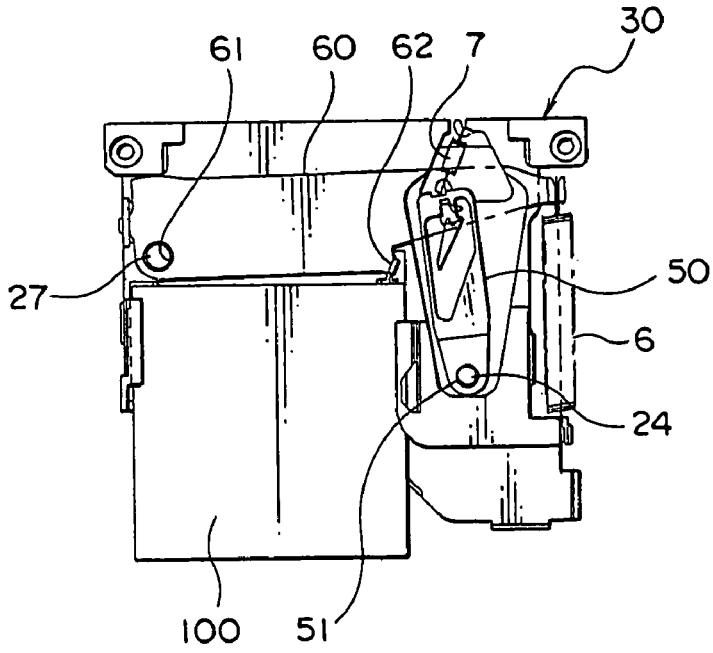
FIG. 12 is a top plan view for describing an operation of the card connector in FIGS. 1 to 5 in a stage slightly before the card is completely inserted.
Figure 12A:
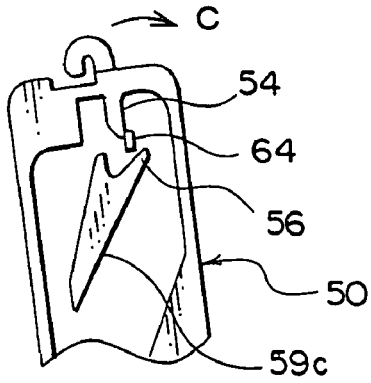
FIG. 12A is an enlarged view of a characteristic part in FIG. 12.

Referring to FIGS. 12 and 12A, the memory card 100 is in the state immediately before it is completely inserted. In FIGS. 11 and 11A, when the protrusion 64 of the lever 60 passes over a protrusion 56 of the heart cam 50, the heart cam 50 is rotated around the rotation shaft 24 in the counterclockwise direction D with the maximum displacement. Since the heart cam 50 is pulled by the second spring 7 to take the untilted position, the heart cam 50 is rotated in the clockwise direction C. Then, a wall 54 of the heart cam 50 collides with the protrusion 64 of the lever 60 to generate a collision sound.

Figure 13:
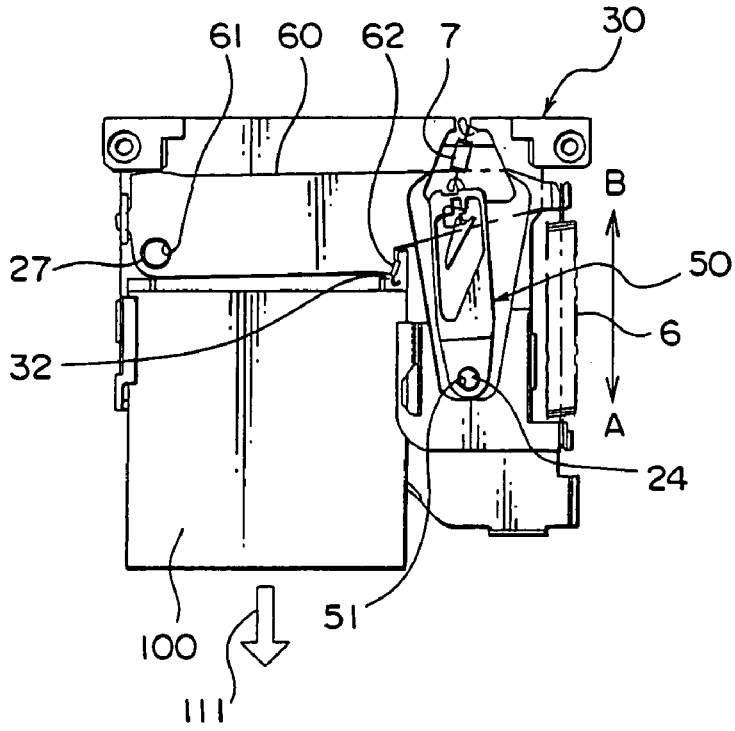
FIG. 13 is a top plan view for describing an operation of the card connector in FIGS. 1 to 5 in a stage immediately before the card is completely inserted.
Figure 13A:
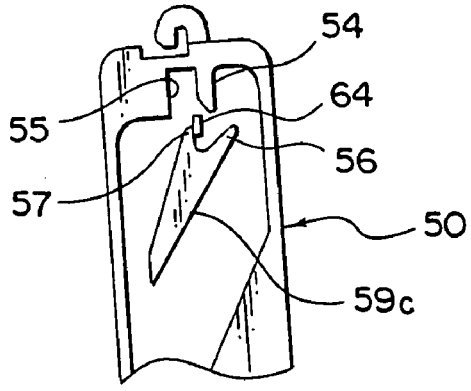
FIG. 13A is an enlarged view of a characteristic part in FIG. 13.

Referring to FIGS. 13 and 13A, the memory card 100 is completely inserted immediately before it is returned to the initial position. When the memory card 100 in the state illustrated in FIGS. 12 and 12A is pushed in the inserting direction B, the memory card 100 collides with the wall 32 of the housing 30. When operator's hold is loosened, the memory card 100 is moved in the ejecting direction A. This is because the lever 60 is continuously pulled by the first spring 6 in the ejecting direction A around the rotation shaft 27 of the insulator 30 and, therefore, the memory card 100 is pushed via the card ejecting portion 62 of the lever 60 in the ejecting direction A. Consequently, the lever 60 colliding with the wall 54 of the heart cam 50 is rotated in the ejecting direction A. Since the heart cam 50 is rotated in the clockwise direction C under the force of the second spring 7, the protrusion 64 of the lever 60 then collides with the protrusion 57 of the heart cam 50 to generate a collision sound. The lever 60 moves in the ejecting direction A into the state illustrated in FIGS. 6 and 6A. Thus, the memory card 100 is moved to the initial position.

With the above-mentioned structure, no step is formed on the bottom of the cam and the lever is required to perform rotational movement alone. Therefore, no spring for pressing a cam follower is necessary. Accordingly, the card connector can be designed to have a reduced thickness.

The moment applied to the lever includes a rotation torque applied by the spring and a rotation torque applied by the memory card. Each of the torques is generated around the rotation support point of the lever. Therefore, a moving path of the lever is stable and friction between the lever and other elements is reduced. Thus, the operation feeling is not impaired.

Figure 5:
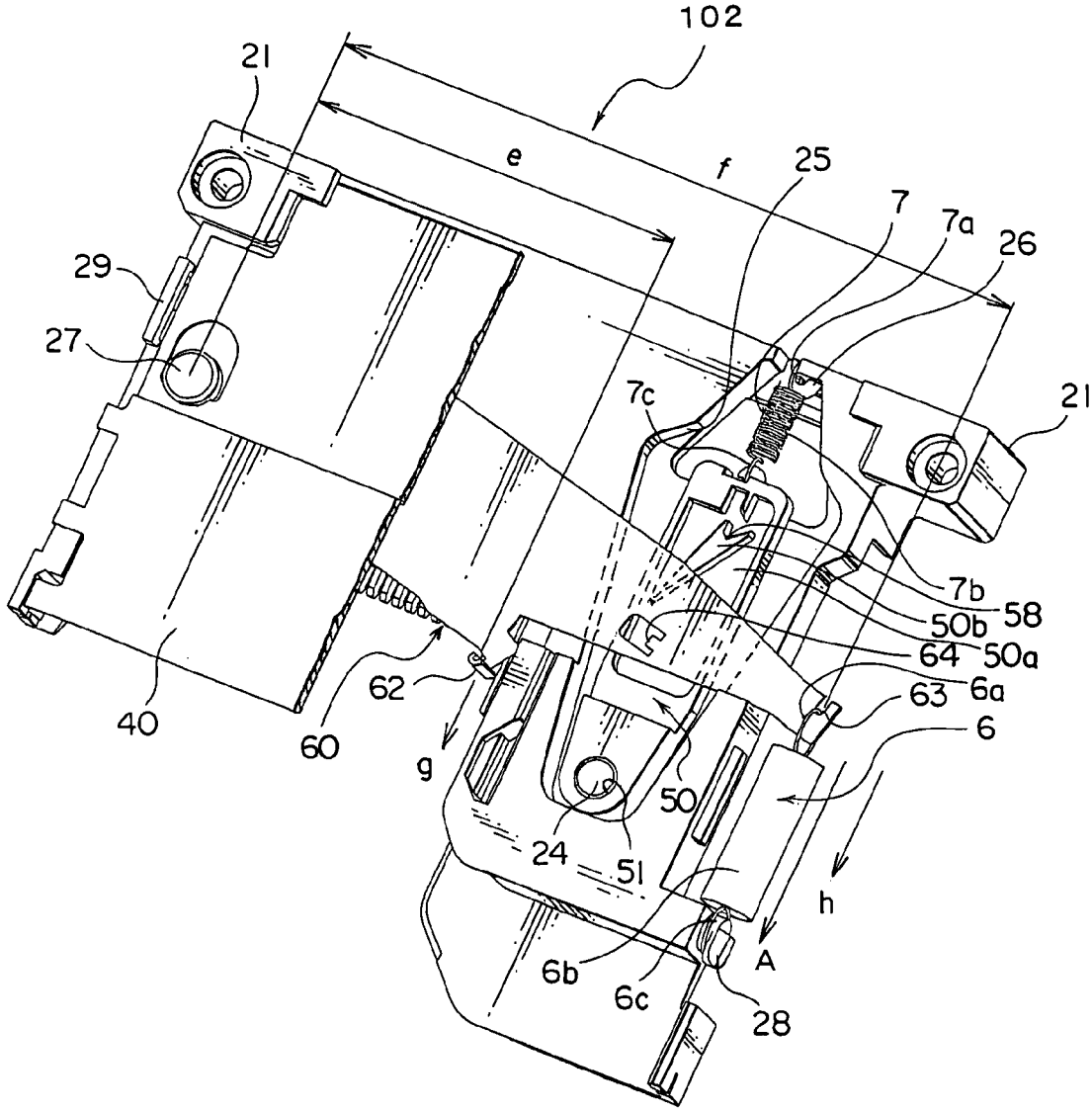
FIG. 5 is a perspective view of the card connector in FIG. 1 with its cover partially cut away.

As described in conjunction with FIG. 5, the lever has the card ejecting portion on the side near the rotation support point and the spring attaching portion formed outside the card ejecting portion to continuously urge the lever in the ejecting direction. At this portion, the relationship in the above equation (1) is produced. From the equation (1):

$$h=g\times e/f \quad (2).$$

Since e/f is smaller than 1, h<g. Thus, h is designed to be small.

Thus, the spring force can be designed to be small so that a sufficient margin is assured in strength of the insulator. By reducing the spring force, deformation or warp of the lever or the insulator is suppressed so that friction with other elements is reduced and the operation feeling is not impaired.

One of the factors determining the operation feeling is a magnitude of the collision sound generated upon collision between the wall of the heart cam and the protrusion of the lever. When the magnitude of the collision sound is large, the operation feeling is good. In the above-mentioned card connector, the heart cam is pulled by the use of the spring so that the protrusion of the lever collides with the wall of the heart cam to generate the collision sound. In a case where the insulator is sufficient in strength, it is possible to increase the strength of the spring. In this event, the rotation force of the heart cam can be enhanced so that the collision sound upon collision with the protrusion of the lever can simply be increased.

Although this invention has been described in conjunction with the preferred embodiment thereof, this invention may be modified in various other manners within the scope of the appended claims. The above-mentioned card connector is applicable to a memory card connector for an electronic apparatus or an electric apparatus such as a digital camera, a portable terminal, and a notebook-type personal computer.

What is claimed is:

1. A card connector to be connected to a card, the card connector comprising:

an ejecting member movable along a predetermined plane for ejecting the card in an ejecting direction, the ejecting member having a card contacting portion to be contacted with the card and a cam-operated portion;

an urging member urging the ejecting member towards the ejecting direction;

a cam movable along the predetermined plane in a direction intersecting the ejecting direction; and a supporting member elastically supporting the cam so that the cam is disposed at a predetermined position, the cam having a cam portion for controlling a position of the ejecting member in cooperation with the cam-operated portion, the cam being rotatable with respect to a rotation shaft perpendicular to the predetermined plane, the rotation shaft being located at one end of the cam, the supporting member having a spring applying a pulling force to the other end of the cam, the cam portion comprising a depressed portion having a bottom surface parallel to the predetermined plane and having no step, and a protruding portion disposed on the depressed portion and defining a generally heart-like contour.

2. The card connector according to claim 1, wherein the spring is a coil spring.

3. The card connector according to claim 1, wherein the one end is located on a card ejecting side while the other end is located on a card inserting side, the protruding portion having a recess formed near the opposite end to receive the cam-operated portion.

4. The card connector according to claim 1, wherein the ejecting member has first and second ends opposite to each other and is rotatable along the predetermined plane around the first end as a support point, the urging member being a tension spring engaged with the second end of the ejecting member.

5. The card connector according to claim 4, wherein the cam-operated portion is disposed between the first and the second ends of the ejecting member.

6. The card connector according to claim 5, wherein the card contacting portion is disposed between the cam-operated portion and the second end of the ejecting member.

7. The card connector according to claim 1, further comprising a housing, the ejecting member, the urging member, the cam, and the supporting member being mounted to the housing.

8. The card connector according to claim 7, further comprising:

a plurality of conductive contacts mounted to the housing; and a locator positioning the conductive contacts with respect to the housing.

9. A card connector to be connected to a card, the card connector comprising:

an ejecting member to be contacted with the card for ejecting the card;

an elastic member urging the ejecting member towards a card ejecting direction; and a cam having a cam portion to be engaged with a cam-operated portion of the ejecting member, the cam portion being operable to lock the ejecting member at a card fitting position when the card is inserted and to unlock the ejecting member when the card is ejected, the cam further comprising a rotation shaft and a supporting member, the cam being rotatably held by the rotation shaft, the supporting member urging the cam so that the cam is disposed at a predetermined position, the cam being rotatable with respect to a rotation shaft perpendicular to the predetermined plane, the rotation shaft being located at one end of the cam, the supporting member having a spring applying a pulling force to the other end of the cam, the cam portion comprising a depressed portion having a bottom surface parallel to the predetermined plane and having no step, and a protruding portion disposed on the depressed portion and defining a generally heart-like contour.

* * * * *